US005221945A

United States Patent [19]

Smith

[11] Patent Number: 5,221,945

[45] Date of Patent: Jun. 22, 1993

[54] TONER CARTRIDGE HAVING AN AIR PASSAGEWAY

[75] Inventor: Mark J. Smith, Rochester, N.Y.

[73] Assignee: Xerox Corporation, Stamford, Conn.

[21] Appl. No.: 929,858

[22] Filed: Aug. 14, 1992

[51] Int. Cl.[5] ..... G03G 15/06

[52] U.S. Cl. ..... 355/260; 222/DIG. 1

[58] Field of Search ..... 355/200, 210, 245, 260; 222/DIG. 1, 325, 544; 141/363, 364

[56] References Cited

U.S. PATENT DOCUMENTS

| | | | |
|---|---|---|---|
| 4,491,161 | 1/1985 | Tamura et al. | 222/DIG. 1 X |
| 4,589,579 | 5/1986 | Morita | 222/DIG. 1 X |
| 4,614,286 | 9/1986 | Yamaguchi et al. | 222/505 |
| 4,834,246 | 5/1989 | Inoue et al. | 206/631 |
| 5,012,289 | 4/1991 | Aldrich et al. | 355/260 |
| 5,018,560 | 5/1991 | Tsukamoto | 355/260 X |

FOREIGN PATENT DOCUMENTS

| | | | |
|---|---|---|---|
| 0009982 | 1/1992 | Japan | 355/260 |

*Primary Examiner*—A. T. Grimley
*Assistant Examiner*—William J. Royer
*Attorney, Agent, or Firm*—H. Fleischer; J. E. Beck; R. Zibelli

[57] ABSTRACT

A toner cartridge in which a container defines an open ended chamber. The container is adapted to store a supply of toner in the chamber thereof. The open end of the chamber is sealed. A passageway is formed through the toner in the chamber. As the seal is peeled from the open end of the chamber, toner is discharged therefrom. As toner is discharged from the chamber, air displaced from the hopper receiving the toner moves from the hopper through the passageway onto the upper surface of the toner. In this way, displaced air does not impede the flow of toner particles and maintains a substantially uniform pressure on the discharging toner particles.

14 Claims, 3 Drawing Sheets

TONER CARTRIDGE HAVING AN AIR PASSAGEWAY

Figure 1:
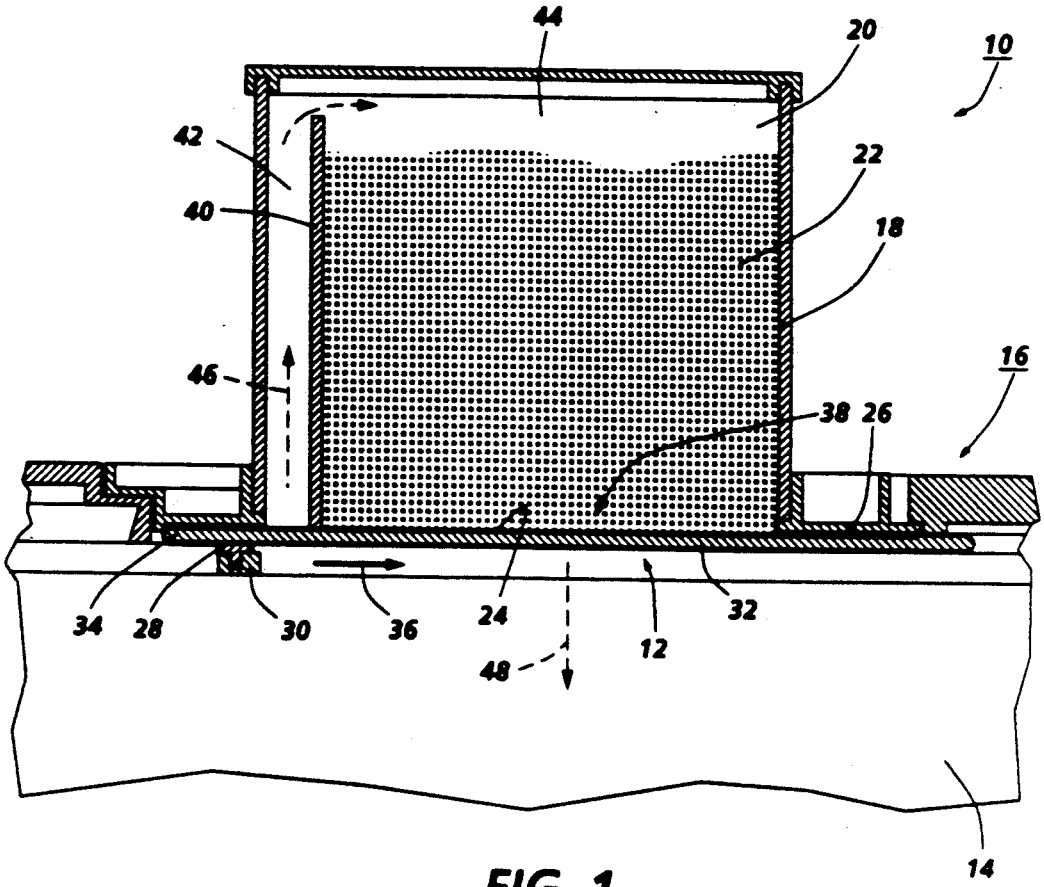

This invention relates generally to a toner cartridge, and more particularly concerns an improved toner cartridge having an air passageway therein.

Generally, in an electrical photographic printing machine, a two-component developer material or a one-component developer material is employed. In a two-component developer material, toner particles adhere to carrier granules. In a one-component developer material, only toner particles are employed. A certain amount of toner is consumed every time a copy is made in the electrophotographic printing machine. Therefore, it is necessary to supply additional toner after a number of copies have been made. A toner cartridge is usually mounted by the operator to discharge additional toner into the developer unit.

Various types of toner containers have been employed for furnishing additional toner particles to the developer unit. One type of toner container has an opening which is sealed by a film-like material. The film-like material is peeled from the opening and the toner discharged into the hopper of the developer unit. Other types of toner cartridges have a sliding cover mounted in the opening of the container. As the cover is removed by the operator, toner is discharged from the container into the hopper of the developer unit. None of these containers provide for the removal of air being displaced by the toner in the hopper of the developer unit. In addition, these toner cartridges do not provide for filling the cartridge with air as toner is being discharged therefrom. Thus, as the toner is being dispensed into the printing machine, developer unit hopper, air is attempting to exit from the hopper and enter the toner cartridge. This impedes the flow of toner from the cartridge into the hopper forming toner powder clouds which escape and contaminate other subsystems within the printing machine as well as dirtying the operator. It is thus clear, that this approach is not always a "white glove" technique.

The following disclosures may be relevant to various aspects of the present invention:

U.S. Pat. No. 4,614,286 Patentee: Yamaguchi et al. Issued: Sep. 30, 1986

U.S. Pat. No. 4,834,246 Patentee: Inoue et al. Issued: May 30, 1989

The relevant portions of the foregoing disclosures may be briefly summarized as follows:

U.S. Pat. No. 4,614,286 discloses a toner container defining a chamber having an open end therein. The open end of the toner container is sealed by a film-like sheet surrounding a sliding cover. When the sliding cover slides, the film-like seal is peeled from the open end of the toner container. When the sliding cover slides back, the film seal again seals the opening of the toner container.

U.S. Pat. No. 4,834,246 describes a toner cartridge having a bottom opening for discharging toner. A sealing film is secured to the container covering the bottom opening. The sealing film may be peeled from the container opening the chamber for discharging toner particles therefrom. A cover is attached to the cartridge container beneath the sealing film and engages the sealing film such that movement of the cover peels the sealing film from the bottom opening. When the direction of movement of the cover is reversed, the bottom opening of the toner container is resealed.

In accordance with one aspect of the present invention, there is provided a toner cartridge. The toner cartridge includes a toner container defining an open ended chamber. The container is adapted to store a supply of toner in the chamber thereof. Means are provided for sealing the open end of the chamber of the container. Means form a passageway in the chamber of the container. Air flows through the passageway from the open end of the chamber to a location adjacent the toner opposed from the open end of the chamber during removal of the sealing means from the open end of the chamber.

Pursuant to another aspect of the present invention, there is provided a developer housing having a toner receiving opening and a support portion therearound. A container is mounted on the support portion of the housing. The container defines an open ended chamber for storing a supply of toner therein. Means seal the open end of the chamber of the container. Means are provided for forming a passageway in the chamber of the container. Air flows through the passageway from the housing through the open end of the chamber to a location adjacent the toner opposed from the open end of the chamber during removal of the sealing means from the open end of the container and discharges toner into the housing.

Figure 2A:
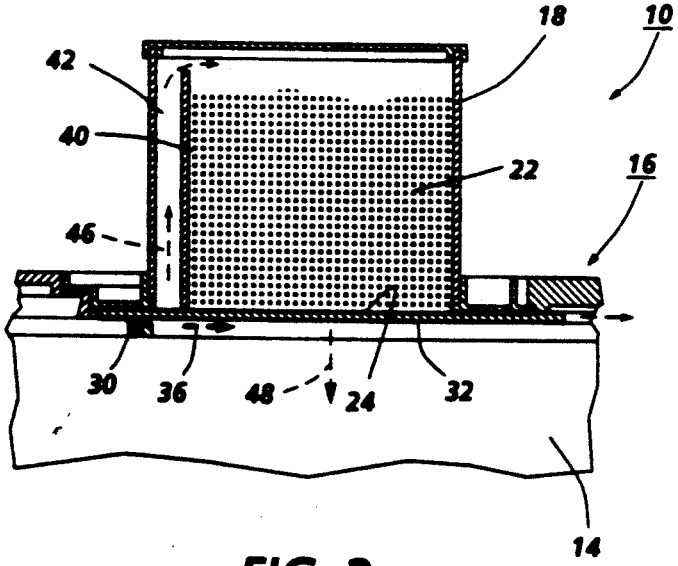
Figure 2B:
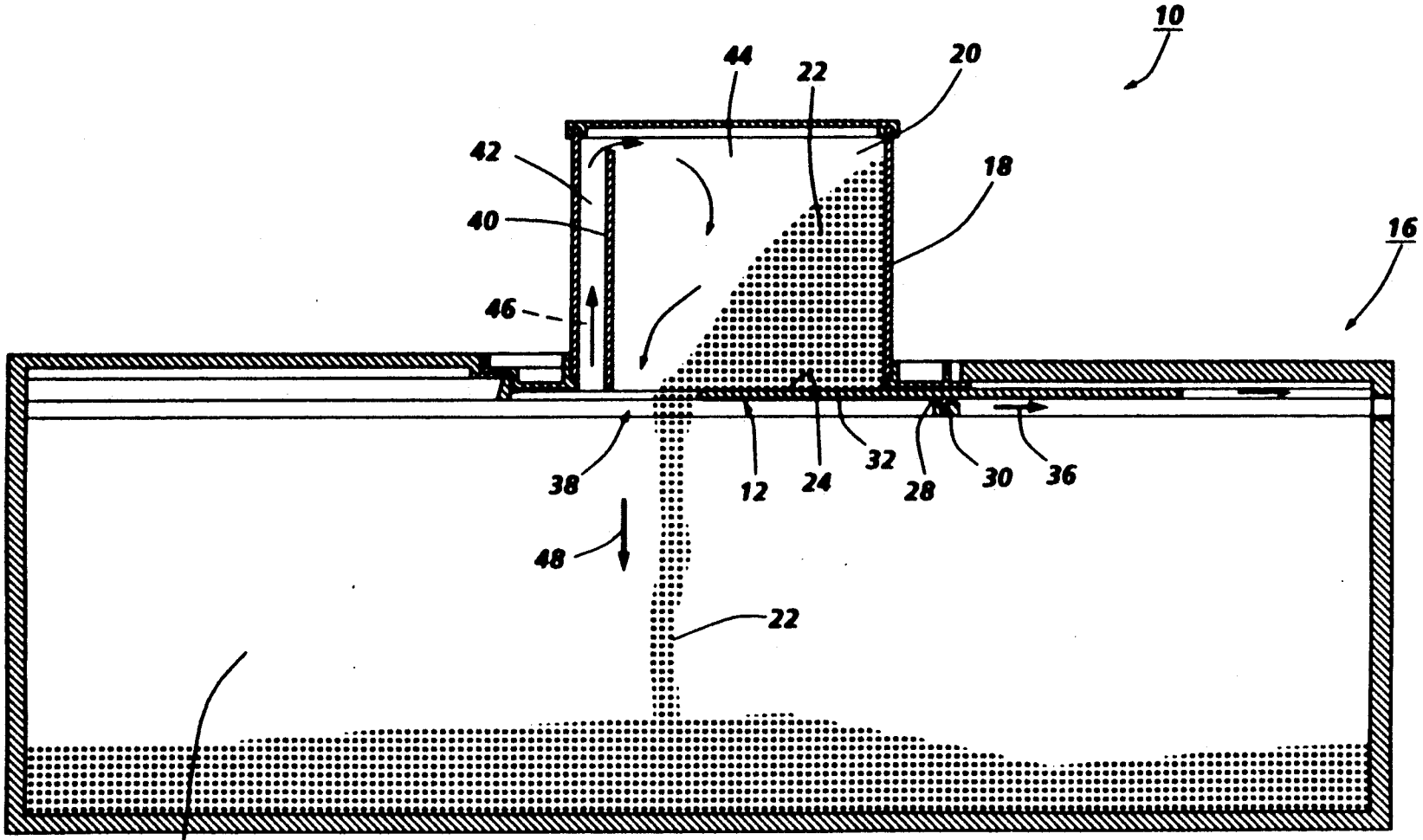
Figure 2C:
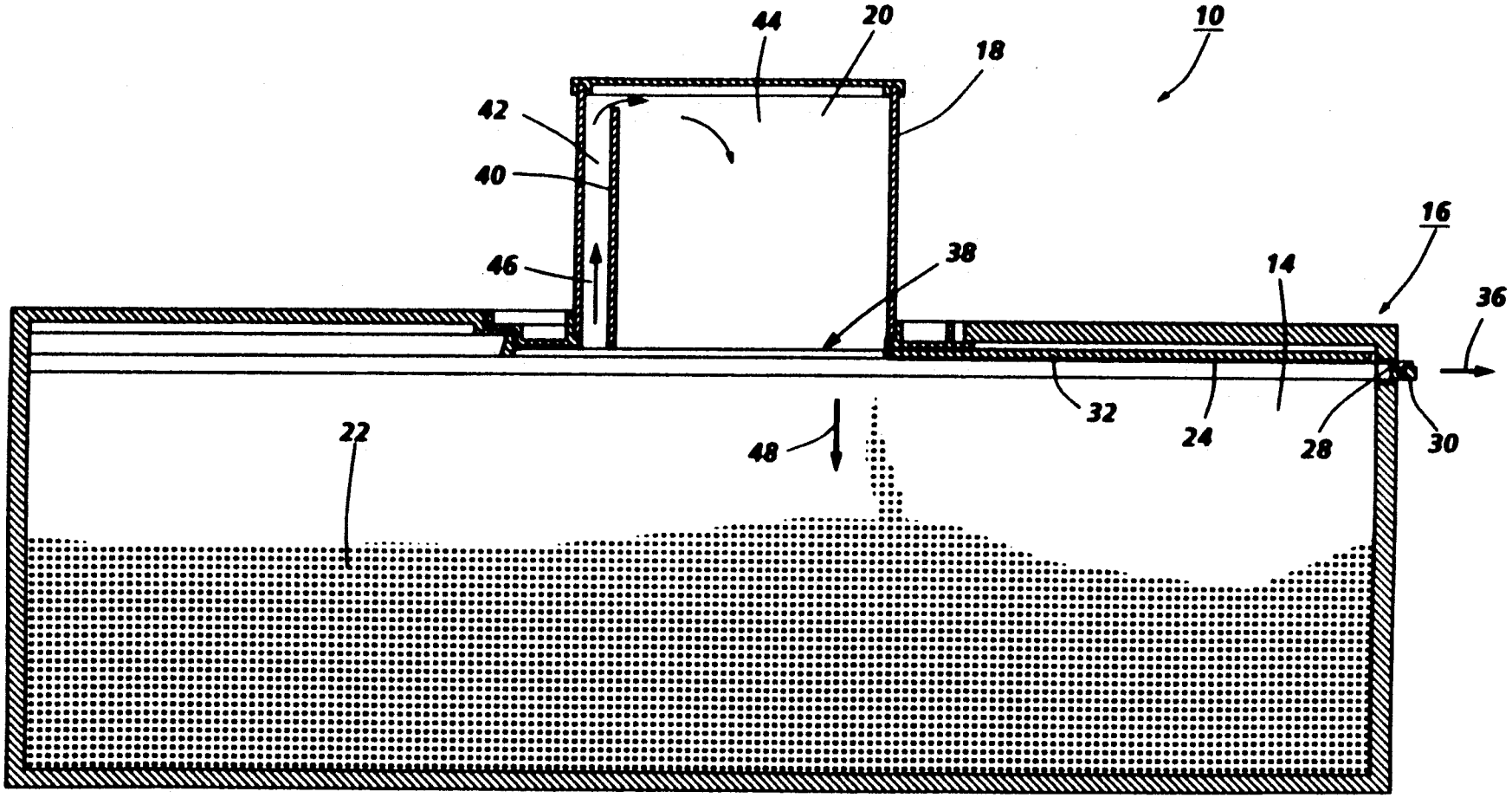

Other features of the present invention will become apparent as the following description proceeds and upon reference to the drawings, in which:

FIG. 1 is a schematic elevational view showing the toner cartridge of the present invention mounted on a developer unit of an electrophotographic printing machine; and FIGS. 2A through 2C, inclusive, show, in sequence, the opening of the toner container and the discharge of toner particles therefrom with the resulting air flow.

While the present invention will be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Turning initially to FIG. 1, there is shown a detailed description of the toner toner cartridge of the present invention. The toner cartridge, indicated generally by the reference numeral 10, is adapted to be mounted detachably onto a toner receiving opening of a developer unit used in an electrophotographic printing machine. The developer unit has a support portion around the toner receiving opening. In this way, toner particles discharged from the toner cartridge are dispensed through toner receiving opening 12 into hopper 14 of developer unit 16. The toner particles discharged from toner cartridge 10 into hopper 14 furnish fresh toner particles replacing those depleted therefrom during the formation of copies by the printing machine. Toner cartridge 10 includes a toner container 18. Toner container 18 defines a chamber 20 adapted to store a supply of toner particles 22 therein. Chamber 20 is open ended. A sealing film 24 is adhesively secured to container 18 and covers the open end of chamber 20. The sealing film is secured adhesively around the periphery of the open end of the chamber of the toner container.

By way of example, sealing film 24 may be made from any suitable flexible material, such as Tyvek. One end 26 of sealing film 24 is attached adhesively to container 18. The other end 28 of sealing film 24 is attached adhesively to sliding member 30. A cover 32 is interposed between sliding member 30 and sealing film 24. Cover 32 is mounted slidably on container 18 and covers the open end of the chamber of the toner container. A portion of sealing film 24 is wrapped around end 34 of cover 32 so that end 28 may be attached to sliding member 30. Sliding member 30 is adapted to move in the direction of arrow 36. As sliding member 30 moves in the direction of arrow 36, sealing film 24 is peeled from toner container 18. Simultaneously, cover 32 moves in unison therewith in the direction of arrow 36. A plate 40 mounted interiorly of chamber 20 on toner container 18 extends upwardly from opening 38 of chamber 20. Plate 40 extends across chamber 20 of toner container 18 so as to partition chamber 20 into a first region 42 and a second region 44. Region 42 is substantially devoid of toner particles. Region 44 stores the supply of toner particles 22 therein. In this way, as sealing film 24 is peeled from toner container 18, air flows from hopper 14 in the direction of arrow 46 over the upper end of plate 40 onto the upper surface of the toner particles. A toner cartridge of this type, exclusive of the plate defining the air passageway is described in U.S. Pat. No. 4,834,246 issued to Inoue et al. in 1989, the relevant portions thereof being incorporated into the present application.

The upper surface of the toner particles is opposed from the lower surface thereof, which is adjacent the open end of chamber 20. Thus, as toner particles are discharged in the direction of arrow 48 into hopper 14, air, displaced from hopper 14, moves in the direction of arrow 46 through the opening 38 of chamber 20 over the upper end of plate 40 onto the upper surface of the toner particles. This provides a passageway for the air being displaced from hopper 14 and, simultaneously, maintains a substantially uniform air pressure on the upper surface of the toner particles being discharged. The foregoing will be more clearly described with reference to FIGS. 2A through 2C, inclusive. It is clear that plate 40 in combination with the side wall, opposed therefrom, of container 18 defines a conduit through with air flows in the direction of arrow 46. One skilled in the art will appreciate that a tube may be utilized in lieu of plate 40. The tube defines a passageway or conduit from the open end of the chamber to the upper surface of the toner particles through which air displaced from the hopper flows. The detailed operation of the present invention will be described hereinafter with reference to FIGS. 2A through 2C, inclusive.

Referring now to FIG. 2A, there is shown sliding member 30 in the initial position just prior to being moved in the direction of arrow 36. This corresponds to FIG. 1. As illustrated thereat, toner cartridge 10 is mounted on developer unit 16 with container 18 being supported above the toner receiving opening on the supports of developer unit 16.

As shown in FIG. 2B, the sliding member has moved through a portion of its travel and peeled sealing film 24 from opening 38 of container 18. This results in toner particles 22 being discharged from chamber 20 of container 18. As the toner particles are discharged from the chamber of the toner container, air is displaced from hopper 14 of developer unit 16. The displaced air flows in the direction of arrow 46 through opening 38 into the passageway or first region 42 over the upper end of plate 40 into the second region over the upper surface of the toner particles. This maintains a substantially uniform pressure on the toner particles as they are being discharged from the toner container into the developer unit hopper. Moreover, this provides an air passageway for the air being displaced from hopper 14.

As shown in FIG. 2C, sealing film 24 is completely removed from opening 38 of chamber 20. At this time, the remaining toner particles are discharged from region 44 of chamber 20 and air flows from hopper 14 through region 42 into region 44 above the toner particles being discharged therefrom. After all of the toner particles have been discharged from region 44 of chamber 20, sliding member 30 may be moved in a direction opposed to that of arrow 36 re-sealing opening 38 with sealing film 24 and cover 32. After opening 38 has been re-sealed, toner cartridge 10 may be removed from developer unit 16. The toner cartridge may now be recycled for refilling with toner particles for subsequent reuse.

In recapitulation, it is clear that the toner cartridge of the present invention includes a passageway substantially devoid of toner particles. As toner particles are discharged from the toner cartridge, air flows through the passageway onto the uppermost surface of the toner particles maintaining a substantially uniform pressure thereon. The air originates from the housing into which the toner particles are being discharged. Thus, the air is displaced by the toner particles and flows into the toner cartridge through the passageway onto the upper surface of the toner particles. The passageway provides a path of least resistance for the displaced air enabling clean discharge of toner particles between the cartridge and the hopper of the developer unit.

It is, therefore, apparent that there has been provided in accordance with the present invention, a toner cartridge that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. A toner cartridge, including:

a container defining an open ended chamber, said container being adapted to store a supply of toner in the chamber thereof with the toner having one surface adjacent the open end of the chamber and another surface opposed therefrom;

means for sealing the open end of the chamber of said container; and means for forming a passageway in the chamber of said container with air flowing through the passageway from the open end of the chamber to a location adjacent the surface of the toner opposed from the open end of the chamber during removal of said sealing means from the open end of said container.

2. A toner cartridge according to claim 1, wherein said forming means partitions the chamber of said container into a first region substantially devoid of toner and a second region adapted to store the supply of toner therein.

3. A toner cartridge according to claim 2, wherein said forming means includes a conduit having a conduit interior and a conduit exterior with said conduit being positioned in the chamber and extending from the open end thereof to the location adjacent the surface of the toner opposed from the open end of the chamber with the first region being the conduit interior and the second region being the conduit exterior.

4. A toner cartridge according to claim 2, wherein said forming means includes a plate mounted in the chamber of said container and extending thereacross, said plate being spaced from a wall of said container with the space therebetween being the first region and the remainder of the chamber being the second region.

5. A toner cartridge according to claim 2, wherein said sealing means includes a sealing film removably attached to said container for sealing the open end of the chamber with said sealing film being adapted to be peeled from said container to open the open end of the chamber enabling toner to be discharged therefrom.

6. A toner cartridge according to claim 5, wherein said sealing means is adhesively attached to said container.

7. A toner cartridge according to to claim 5, wherein said sealing means includes a member mounted slidably on said container and having a marginal region of said sealing film attached thereto, said member being slidable from a first position in which said sealing means seals the open end of the chamber to a second position in which said sealing means is peeled from the open end of the chamber.

8. A developer unit, including:

a developer housing having a toner receiving opening and a support portion therearound;

a container mounted on the support portion of said housing, said container defining an open ended chamber for storing a supply of toner therein with the toner having one surface adjacent the open end of the chamber and another surface opposed therefrom, said container having the open end of the chamber aligned with the toner receiving opening of said housing;

means for sealing the open end of the chamber of said container; and means for forming a passageway in the chamber of said container with air flowing through the passageway from said housing through the open end of the chamber to a location above the surface of the toner opposed from the open end of the chamber during removal of said sealing means from the open end of said container and discharging toner into said housing.

9. A developer unit according to claim 8, wherein said forming means partitions the chamber of said container into a first region substantially devoid of toner and a second region adapted to store the supply of toner therein.

10. A developer unit according to claim 9, wherein said forming means includes a conduit having a conduit interior and a conduit exterior with said conduit being positioned in the chamber and extending from the open end thereof to the location adjacent the surface of the toner opposed from the open end of the chamber with the first region being the conduit interior and the second region being the conduit exterior.

11. A developer unit according to claim 9, wherein said forming means includes a plate mounted in the chamber of said container and extending thereacross, said plate being spaced from a wall of said container with the space therebetween being the first region and the remainder of the chamber being the second region.

12. A developer unit according to claim 9, wherein said sealing means includes a sealing film removably attached to said container for sealing the open end of the chamber with said sealing film being adapted to be peeled from said container to open the open end of the chamber enabling toner to be discharged therefrom into said housing.

13. A developer unit according to claim 12, wherein said sealing means is adhesively attached to said container.

14. A developer unit according to claim 12, wherein said sealing means includes a member mounted slidably on said container and having a marginal region of said sealing film attached thereto, said member being slidable from a first position in which said sealing film seals the open end of the chamber to a second position in which said sealing film is peeled from the open end of the chamber enabling toner to be discharged therefrom into said housing.

* * * * *